United States Patent [19]

Parker

[11] Patent Number: 4,526,523

[45] Date of Patent: Jul. 2, 1985

[54] OIL PRESSURE CONTROL SYSTEM

[75] Inventor: Charles A. Parker, Saylorsburg, Pa.

[73] Assignee: Ingersoll-Rand Company, Woodcliff Lake, N.J.

[21] Appl. No.: 610,678

[22] Filed: May 16, 1984

[51] Int. Cl.[3] ..... F04C 29/02; F04B 39/02; F01M 1/16; F01M 5/00

[52] U.S. Cl. ..... 418/84; 418/85; 418/87; 418/88; 417/228; 184/6.4; 184/6.11; 184/6.22

[58] Field of Search ..... 418/84, 87, 88, 85; 417/228; 184/6.16, 6.4, 6.11, 6.22

[56] References Cited

U.S. PATENT DOCUMENTS

| | | | |
|---|---|---|---|
| 1,877,345 | 9/1932 | Mattmann | 418/84 |
| 2,796,075 | 6/1957 | Focht | 184/6.4 |
| 3,441,200 | 4/1969 | Huesgen | 417/228 |
| 4,245,465 | 1/1981 | Milo | 184/6.11 |
| 4,276,960 | 7/1981 | Webb et al. | 417/228 |

FOREIGN PATENT DOCUMENTS

| | | | |
|---|---|---|---|
| 2708527 | 9/1977 | Fed. Rep. of Germany | 418/87 |

*Primary Examiner*—John J. Vrablik

*Attorney, Agent, or Firm*—Bernard J. Murphy

[57] ABSTRACT

The system comprises an arrangement for supplying sealing and lubrication oil to a gas compressor in an embodiment of the invention in which the oil pump is relieved of high pressure demand during normal compressor operating. A pneumatic control valve bypasses a quantity of the pump output in order that the pump can run with less energy demand. The valve is controlled by biasing and limiting pneumatic relays, and a pressure controller which regulate the bypass of pumped oil to a reservoir. One biasing relay adds a measure of pressure to a pilot signal, addressed to the control valve, to accommodate for line losses, and another relay establishes a lower, pilot signal limit, to insure that the oil pressure will not go below the pressure of coolant in an oil cooler.

1 Claim, 1 Drawing Figure

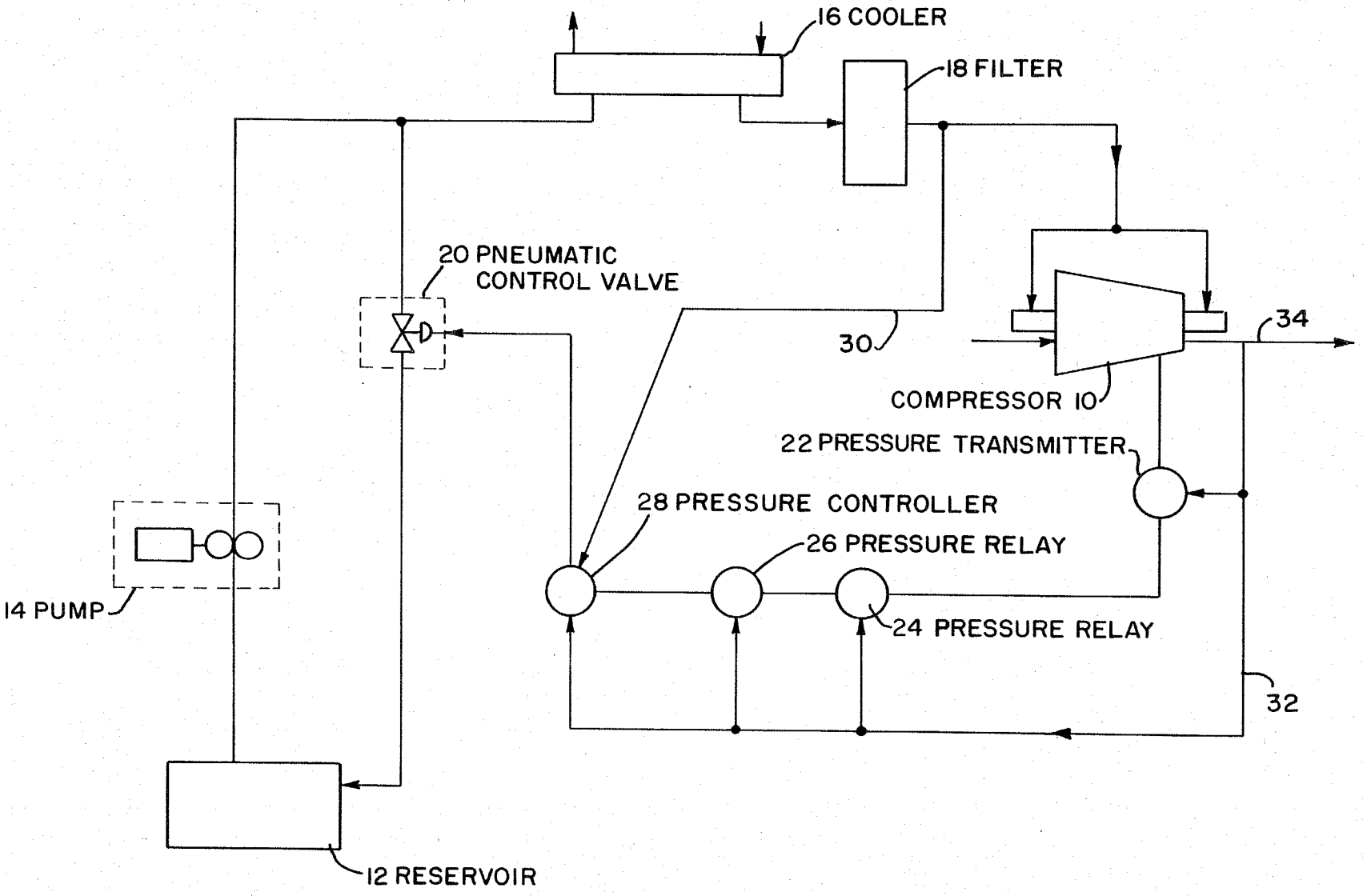
34
32
COMPRESSOR 10
22 PRESSURE TRANSMITTER
26 PRESSURE RELAY
24 PRESSURE RELAY
18 FILTER
16 COOLER
30
28 PRESSURE CONTROLLER
20 PNEUMATIC CONTROL VALVE
12 RESERVOIR
14 PUMP

OIL PRESSURE CONTROL SYSTEM

This invention pertains to oil pressure control systems, and in particular to such systems which must provide a variable oil pressure in response to the demands of a machine which, in turn, operates under variable fluid pressures.

Oil pressure control systems of the aforesaid type are known in the prior art. Commonly they employ a heavy-duty oil pump which operates constantly at the highest pressure to insure the supply of oil at the maximum pressure requirement therefor. Alternatively, other prior art systems of this type use a booster oil pump which is periodically activated to supply a peak demand for high pressure oil. In the first circumstance, such systems are not economical in that most of the time the oil pump is running and expending excessive energy when there is no demand for high pressure oil. The second circumstance is not economical either, in that it requires a second pump, and all the ancillary piping and controls therefor.

It is an object of this invention to set forth an oil pressure control system which does not require the pump to run constantly, as if under peak demand performance, as well as a system which obviates any requirement for a secondary or booster oil pump.

Particularly it is an object of this invention to set forth an oil pressure system for a variable-pressure, fluid-working machine, such as a pump, gas compressor, gas expander, or the like, having an oil pressure admittance requirement variable with the pressure of fluid worked by said machine, comprising reservoir means for providing a source of oil; a pump; first means communicating said pump with said reservoir means; second means interposed between, and communicating, said pump and said reservoir means for controlling oil flow from said pump to said reservoir means; a conduit communicating with said first means, intermediate said pump and said second means, for conducting oil to a variable pressure, fluid-working machine; wherein said second means comprises means, responsive to fluid-pressure, pilot signals communicated thereto for modulatingly regulating oil flow to said reservoir means; and further including sensor means having means for operative and intrusive coupling thereof to such an aforesaid machine for (a) sensing the pressures of fluid worked by such machine, and (b) producing fluid pressure, pilot signals representative of such sensed pressures; and means mutually coupling said sensor means and said second means for communicating pilot signals, produced by said sensor means, to said second means.

Further objects of this invention as well as the novel features thereof will become more apparent by reference to the following description taken in conjunction with the accompanying schematic diagram.

As shown in the diagram a machine comprising a gas compressor 10 is supplied oil, for sealing and lubrication, from a reservoir 12 by means of a pump 14. The oil is conducted through a cooler 16 and a filter 18 before injection into the compressor 10. However, the compressor has a limited demand for oil, while it is operating; it is only at shutdown (i.e., under settling out condition), when the compressor is sealed off under high pressure, that there is a heavy, back-pressure demand on the pump 14 for oil under maximum pressure. Accordingly, the invention sets forth the use of a pneumatic control valve 20 which bypasses given quantities of the pump discharge, and returns such to the reservoir 12.

A pressure transmitter 22 is coupled to the compressor 10 and senses the pressure of the working fluid within the machine at any given time. The pressure transmitter produces a fluid-pressure, pilot signal having a range of from approximately 3 to 15 psig. This corresponds, generally, to a pressure of the working fluid (gas) in the compressor 10 of from 0 psig to some maximum pressure (viz., 300 psig). This pilot signal is not communicated directly to the pneumatic control valve 20 in that it would not be adequate. It is necessary to add to the pilot signal an additional increment of pressure to make up for piping and component losses in the system. For this purpose a bias pressure relay 24 is provided. For exemplary purposes the latter relay 24 enhances the pilot signal by 2 psig. Next the enhanced pilot signal is conducted to a low limit relay 26. The latter relay 26 is provided to protect the cooler 16. Coolant is passed through the oil cooler 16 at a given pressure, and it is necessary to insure that the pressure of oil counter-flowing through the cooler is at a greater pressure (than that of the coolant). Should there occur a leak in the cooler 16 it is preferred that the oil insinuate itself into the coolant, rather then vis-a-versa, as contaminated oil would do great damage to the compressor 10. Accordingly, the low limit relay establishes a lowermost, threshold oil pressure for the pilot signal. In this exemplary embodiment, the lowermost, threshold oil pressure must be 70 psig., and this correlates with a pilot signal pressure of 5.8 psig. Finally, the enhanced pilot signal, with the lower limit established, is communicated to a pressure controller 28. The controller 28 compares the pilot signal received with that of the pressure of the oil flowing to compressor 10, and gives an optimum control signal to the pneumatic control valve 20. In turn, and responsive to the level of the signal from the controller 28, the pneumatic control valve bypasses a given quantity of the oil from the pump back into the reservoir. Accordingly, the pump works under reduced back pressure, and has a limited energy demand, therefore, all the while that the compressor is in operation.

Line 30 provides a tap, in the oil flow to the compressor 10, for feedback to the controller 28; it is this tapped feedback which the controller 28 uses for comparison with the pilot signal it receives. Line 32 supplies air to relays 24 and 26, transmitter 22, and the controller 28, to enable their biasing, limiting, transmitting and controlling functions.

In the exemplary embodiment shown and described, the sources of components are as follows: the pneumatic control valve 20, model 657 EDR, Fisher Controls Company, Marshalltown, Iowa 50158; the pressure transmitter 22, model 50 PW3, Moore Products Company, Spring House, Pa. 19477; the bias pressure relay 24, model 680, Moore Products Company; the low limit (pressure) relay 26, model 58L, Moore Products Company; and the pressure controller 28, model 4195 BME, Fisher Controls Company.

While I have described my invention in connection with a specific embodiment thereof, it is to be clearly understood that this is done only by way of example, and not as a limitation to the scope of my invention, as set forth in the objects thereof and in the appended claims.

I claim:

1. In combination, a gas compressor having an oil pressure admittance requirement variable with the pressure of gas worked thereby, and a lubrication and seal oil pressure control system for said compressor, comprising:

reservoir means for providing a source of oil;

a pump;

first means communicating said pump with said reservoir means;

second means interposed between, and communicating, said pump and said reservoir means for controlling oil flow from said pump to said reservoir means;

a gas compressor;

a conduit communicating with said first means, intermediate said pump and said second means, for conducting oil to said gas compressor; wherein said second means comprises means, responsive to fluid-pressure, pilot signals communicated thereto for modulatingly regulating oil flow to said reservoir means; and further including sensor means intrusively coupled to said compressor for (a) sensing the pressures of fluid worked by said compressor, and (b) producing fluid pressure, pilot signals representative of such sensed pressures;

means mutually coupling said sensor means and said second means for communicating pilot signals, produced by said sensor means, to said second means;

an oil cooler, interposed between said pump and compressor, for passing oil therethrough and for cooling oil therewithin;

said cooler having coolant supplied thereto, and passed therethrough at a given pressure, for cooling of oil therewithin; and means interposed between said sensor means and said second means for (a) gauging said pilot signals to determine the fluid pressure levels thereof, and (b) enhancing said pilot signals, as required, to insure that the latter maintain at least a given, lowermost, pressure threshold in which said pump supplies oil to said oil cooler at a pressure which is greater than said given pressure.

* * * * *